US011338312B2

(12) United States Patent
Fritz et al.

(10) Patent No.: US 11,338,312 B2
(45) Date of Patent: May 24, 2022

(54) PRINT HEAD AND ASSOCIATED OPERATING METHOD

(71) Applicant: Dürr Systems AG, Bietigheim-Bissingen (DE)

(72) Inventors: Hans-Georg Fritz, Ostfildern (DE); Benjamin Wöhr, Eibensbach (DE); Marcus Kleiner, Besigheim (DE); Moritz Bubek, Ludwigsburg (DE); Timo Beyl, Besigheim (DE); Frank Herre, Oberriexingen (DE); Steffen Sotzny, Oberstenfeld (DE)

(73) Assignee: Dürr Systems AG, Bietigheim-Bissingen (DE)

( * ) Notice: Subject to any disclaimer, the term of this patent is extended or adjusted under 35 U.S.C. 154(b) by 81 days.

(21) Appl. No.: 16/468,695

(22) PCT Filed: Dec. 1, 2017

(86) PCT No.: PCT/EP2017/081152
§ 371 (c)(1),
(2) Date: Jun. 12, 2019

(87) PCT Pub. No.: WO2018/108577
PCT Pub. Date: Jun. 21, 2018

(65) Prior Publication Data

US 2019/0308212 A1 Oct. 10, 2019

(30) Foreign Application Priority Data

Dec. 14, 2016 (DE) ..... 10 2016 014 948.5

(51) Int. Cl.
*B05B 12/14* (2006.01)
*B05B 15/555* (2018.01)
(Continued)

(52) U.S. Cl.
CPC ..... *B05B 12/149* (2013.01); *B05B 1/3053* (2013.01); *B05B 13/0452* (2013.01);
(Continued)

(58) Field of Classification Search
CPC ... B05B 12/149; B05B 15/555; B05B 1/3053; B05B 13/0452; B05B 15/55; B05B 12/14; B41J 2/1707; B41J 2/2103; B41J 2/165
(Continued)

(56) References Cited

U.S. PATENT DOCUMENTS 3,421,694 A 1/1969 Muller
3,717,306 A 2/1973 Hushon et al.
(Continued)

FOREIGN PATENT DOCUMENTS

CN 2287527 Y 8/1998
CN 1331661 A 1/2002
(Continued)

OTHER PUBLICATIONS

EPO Official Notification of Opposition for Application No. 17821803.8 dated Feb. 10, 2021 (64 pages; with English machine translation).
(Continued)

*Primary Examiner* — Kristal Feggins
*Assistant Examiner* — Alexander D Shenderov
(74) *Attorney, Agent, or Firm* — Bejin Bieneman PLC

(57) ABSTRACT

The disclosure concerns a printhead for the application of a coating agent to a component, in particular for painting a vehicle body component with a paint. The disclosure provides that the printhead is designed in such a way that it enables a color change during coating operation and can be rinsed with a rinsing agent during a color change in order to rinse out coating agent residues from the printhead.

26 Claims, 8 Drawing Sheets

(51) Int. Cl.

| | |
|---|---|
| ***B05B 1/30*** | (2006.01) |
| ***B05B 13/04*** | (2006.01) |
| ***B41J 2/165*** | (2006.01) |
| ***B41J 2/21*** | (2006.01) |
| ***B41J 2/17*** | (2006.01) |

(52) U.S. Cl.
CPC ..... *B05B 15/555* (2018.02); *B41J 2/165* (2013.01); *B41J 2/1707* (2013.01); *B41J 2/2103* (2013.01)

(58) Field of Classification Search
USPC ..... 347/47
See application file for complete search history.

(56) References Cited

U.S. PATENT DOCUMENTS 3,981,320 A * 9/1976 Wiggins ..... B05B 5/16 137/240
4,141,231 A 2/1979 Kudlich
4,375,865 A 3/1983 Springer
4,383,264 A 5/1983 Lewis
4,423,999 A 1/1984 Choly
4,430,010 A 2/1984 Zrenner et al.
4,435,719 A 3/1984 Snaper
4,478,241 A 10/1984 Cardenas-Franco
4,555,719 A 11/1985 Arway et al.
4,668,948 A 5/1987 Merkel
4,714,044 A 12/1987 Kikuchi
4,734,711 A 3/1988 Piatt et al.
4,826,135 A 5/1989 Mielke
4,894,252 A 1/1990 Bongen et al.
4,941,778 A 7/1990 Lehmann
4,974,780 A 12/1990 Nakamura et al.
4,985,715 A 1/1991 Cypher et al.
5,050,533 A 9/1991 Zaber
5,072,881 A 12/1991 Taube, III
5,429,682 A 7/1995 Harlow, Jr. et al.
5,435,884 A 7/1995 Simmons et al.
5,538,221 A 7/1996 Joswig
5,556,466 A 9/1996 Martin et al.
5,602,575 A 2/1997 Pauly
5,636,795 A 6/1997 Sedgwick et al.
5,647,542 A 7/1997 Diana
5,659,347 A 8/1997 Taylor
5,681,619 A 10/1997 Ogasawara
5,740,967 A 4/1998 Simmons et al.
5,843,515 A 12/1998 Crum et al.
5,951,882 A 9/1999 Simmons et al.
5,964,407 A 10/1999 Sandkleiva
5,976,343 A 11/1999 Schlaak
6,179,217 B1 1/2001 Yoshida et al.
6,325,302 B1 12/2001 Guzowski
6,540,835 B2 4/2003 Kim et al.
6,607,145 B1 8/2003 Boriani et al.
6,641,667 B2 11/2003 Ochiai et al.
6,712,285 B2 3/2004 Provenaz et al.
6,777,032 B2 8/2004 Ogasahara et al.
6,811,807 B1 11/2004 Zimmermann et al.
6,849,684 B2 2/2005 Poppe et al.
7,160,105 B2 1/2007 Edwards
7,178,742 B2 2/2007 Nellentine et al.
7,182,815 B2 2/2007 Katagami et al.
7,244,310 B2 7/2007 Edwards
7,270,712 B2 9/2007 Edwards
7,357,959 B2 4/2008 Bauer
7,387,071 B2 6/2008 Heinke et al.
7,449,070 B2 11/2008 Fellingham
7,604,333 B2 10/2009 Horsnell
7,757,632 B2 7/2010 Edwards
7,837,071 B2 11/2010 Achrainer
7,901,741 B2 3/2011 Katagami et al.
8,028,651 B2 10/2011 Rademacher et al.
8,118,385 B2 2/2012 Van De Wynckel et al.
8,449,087 B2 5/2013 Kataoka et al.
8,545,943 B2 10/2013 Frankenberger et al.
8,652,581 B2 2/2014 Merchant
8,678,535 B2 3/2014 Beier et al.
8,875,655 B2 11/2014 Pettersson et al.
8,882,242 B2 11/2014 Beier et al.
9,010,899 B2 4/2015 Harjee et al.
9,108,424 B2 8/2015 Wallsten et al.
9,140,247 B2 9/2015 Herre et al.
9,156,054 B2 10/2015 Ikushima
9,266,353 B2 2/2016 Beier et al.
9,393,787 B2 7/2016 Ikushima
9,464,573 B2 10/2016 Remy et al.
9,592,524 B2 3/2017 Fritz et al.
9,701,143 B2 7/2017 Ikushima
9,707,585 B2 7/2017 Reimert et al.
9,844,792 B2 12/2017 Pettersson et al.
9,901,945 B2 2/2018 Fehr et al.
9,914,150 B2 3/2018 Pettersson et al.
10,016,977 B2 7/2018 Stefani et al.
10,105,946 B2 10/2018 Nakamura et al.
10,150,304 B2 12/2018 Herre et al.
10,252,552 B2 4/2019 Pitz et al.
10,272,677 B2 4/2019 Stefani et al.
10,532,569 B2 1/2020 Wallsten et al.
2001/0017085 A1 8/2001 Kubo et al.
2001/0019340 A1 9/2001 Kubo et al.
2002/0024544 A1 2/2002 Codos
2002/0043280 A1 4/2002 Ochiai et al.
2002/0043567 A1 4/2002 Provenaz et al.
2002/0105688 A1 8/2002 Katagami et al.
2002/0109741 A1 8/2002 Okabe et al.
2002/0128371 A1 9/2002 Poppe et al.
2003/0020783 A1 1/2003 Sanada
2003/0041884 A1 3/2003 Bahr
2003/0049383 A1 3/2003 Ogasahara et al.
2004/0028830 A1 2/2004 Bauer
2004/0089234 A1 5/2004 Hagglund et al.
2004/0107900 A1 6/2004 Clifford et al.
2004/0123159 A1 6/2004 Kerstens
2004/0173144 A1 9/2004 Edwards
2004/0221804 A1 11/2004 Zimmermann et al.
2004/0231594 A1 11/2004 Edwards
2004/0238522 A1 12/2004 Edwards
2004/0256501 A1 12/2004 Mellentine et al.
2004/0261700 A1 12/2004 Edwards
2005/0000422 A1 1/2005 Edwards
2005/0015050 A1 1/2005 Mowery et al.
2005/0016451 A1 1/2005 Edwards
2005/0023367 A1 2/2005 Reighard et al.
2005/0156963 A1 7/2005 Song et al.
2005/0243112 A1 11/2005 Kobayashi et al.
2006/0061613 A1 3/2006 Fienup et al.
2006/0068109 A1 3/2006 Frankenberger et al.
2006/0146379 A1 7/2006 Katagami et al.
2006/0238587 A1 10/2006 Horsnell
2006/0251796 A1 11/2006 Fellingham
2007/0062383 A1 3/2007 Gazeau
2007/0292626 A1 12/2007 Larsson et al.
2008/0271674 A1 11/2008 Rademarcher
2008/0309698 A1 12/2008 Nakano et al.
2009/0027433 A1 1/2009 Van De Wynckel et al.
2009/0029069 A1 1/2009 Edwards
2009/0117283 A1 5/2009 Herre
2009/0181182 A1 7/2009 Sloan
2010/0132612 A1 6/2010 Achrainer
2010/0156970 A1 6/2010 Ikushima
2010/0170918 A1 7/2010 Achrainer
2010/0225685 A1 9/2010 Kwon et al.
2010/0279013 A1 11/2010 Frankenberger et al.
2010/0282283 A1 11/2010 Bauer
2010/0321448 A1 12/2010 Buestgens et al.
2011/0014371 A1 1/2011 Herre et al.
2011/0084150 A1 4/2011 Merchant
2011/0248046 A1 10/2011 Simion
2011/0262622 A1 10/2011 Herre
2012/0085842 A1 4/2012 Ciardella
2012/0105522 A1 5/2012 Wallsten
2012/0114849 A1 5/2012 Melcher
2012/0162331 A1 6/2012 Kataoka

(56) References Cited

U.S. PATENT DOCUMENTS

| | | | |
|---|---|---|---|
| 2012/0186518 | A1 | 7/2012 | Herre |
| 2012/0219699 | A1 | 8/2012 | Pettersson et al. |
| 2012/0249679 | A1 | 10/2012 | Beier et al. |
| 2012/0282405 | A1 | 11/2012 | Herre |
| 2013/0201243 | A1 | 8/2013 | Yoshida |
| 2013/0215203 | A1 | 8/2013 | Chen |
| 2013/0257984 | A1 | 10/2013 | Beier et al. |
| 2013/0284833 | A1 | 10/2013 | Fritz et al. |
| 2014/0076985 | A1 | 3/2014 | Pettersson et al. |
| 2014/0242285 | A1 | 8/2014 | Pettersson et al. |
| 2014/0329001 | A1 | 11/2014 | Rouaud et al. |
| 2015/0009254 | A1 | 1/2015 | Kaiba et al. |
| 2015/0042716 | A1 | 2/2015 | Beier et al. |
| 2015/0086723 | A1 | 3/2015 | Bustgens |
| 2015/0098028 | A1 | 4/2015 | Ohnishi |
| 2015/0328654 | A1 | 11/2015 | Schwab |
| 2015/0375258 | A1 | 12/2015 | Fritz et al. |
| 2015/0375507 | A1 | 12/2015 | Ikushima |
| 2016/0052312 | A1 | 2/2016 | Pitz et al. |
| 2016/0074822 | A1 | 3/2016 | Han |
| 2016/0288552 | A1 | 10/2016 | Ikushima |
| 2016/0306364 | A1 | 10/2016 | Ikushima et al. |
| 2017/0087837 | A1 | 3/2017 | Stefani et al. |
| 2017/0106393 | A1 | 4/2017 | Hamspon et al. |
| 2017/0136481 | A1 | 5/2017 | Fritz et al. |
| 2017/0252765 | A1 | 9/2017 | Medard et al. |
| 2017/0267002 | A1 | 9/2017 | Pitz et al. |
| 2017/0299088 | A1 | 10/2017 | Rau |
| 2017/0361346 | A1 | 12/2017 | Lahidjanian et al. |
| 2018/0022105 | A1 | 1/2018 | Nakamura et al. |
| 2018/0056670 | A1 | 3/2018 | Kerr |
| 2018/0093491 | A1 | 4/2018 | Murayama et al. |
| 2018/0178505 | A1 | 6/2018 | Stefani et al. |
| 2018/0222186 | A1 | 8/2018 | Stefani et al. |
| 2018/0250955 | A1 | 9/2018 | Herre |
| 2019/0091712 | A1 | 3/2019 | Medard et al. |

FOREIGN PATENT DOCUMENTS

| | | | |
|---|---|---|---|
| CN | 1438942 | A | 8/2003 |
| CN | 1512919 | A | 7/2004 |
| CN | 1176815 | C | 11/2004 |
| CN | 1668386 | A | 9/2005 |
| CN | 1761530 | A | 4/2006 |
| CN | 101264698 | A | 9/2008 |
| CN | 101309755 | A | 11/2008 |
| CN | 101657264 | A | 2/2010 |
| CN | 101784348 | A | 7/2010 |
| CN | 102177002 | A | 9/2011 |
| CN | 102198434 | A | 9/2011 |
| CN | 102971080 | A | 3/2013 |
| CN | 103153483 | A | 6/2013 |
| CN | 103909743 | A | 7/2014 |
| CN | 104613205 | A | 5/2015 |
| CN | 104994966 | A | 10/2015 |
| CN | 105358259 | A | 2/2016 |
| CN | 205042649 | U | 2/2016 |
| CN | 106414081 | A | 2/2017 |
| DE | 1284250 | A | 11/1968 |
| DE | 7710895 | U1 | 9/1977 |
| DE | 3045401 | A1 | 7/1982 |
| DE | 3221327 | A1 | 9/1983 |
| DE | 3225554 | A1 | 1/1984 |
| DE | 3634747 | A1 | 8/1987 |
| DE | 3804092 | A1 | 9/1988 |
| DE | 4115111 | A1 | 11/1991 |
| DE | 4138491 | A1 | 5/1993 |
| DE | 9405600 | U1 | 6/1994 |
| DE | 68924202 | T2 | 2/1996 |
| DE | 19606716 | C1 | 8/1997 |
| DE | 19630290 | A1 | 1/1998 |
| DE | 19731829 | A1 | 1/1999 |
| DE | 19743804 | A1 | 4/1999 |
| DE | 9422327 | U1 | 3/2000 |
| DE | 19852079 | A1 | 5/2000 |
| DE | 19936790 | A1 | 2/2001 |
| DE | 20017629 | U1 | 3/2001 |
| DE | 10048749 | A1 | 4/2002 |
| DE | 69429354 | T2 | 5/2002 |
| DE | 69622407 | T2 | 3/2003 |
| DE | 10307719 | A1 | 9/2003 |
| DE | 60001898 | T2 | 2/2004 |
| DE | 102004021223 | A1 | 12/2004 |
| DE | 10331206 | A1 | 1/2005 |
| DE | 102004034270 | A1 | 2/2006 |
| DE | 102004044655 | A1 | 3/2006 |
| DE | 102004049471 | A1 | 4/2006 |
| DE | 60212523 | T2 | 2/2007 |
| DE | 69836128 | T2 | 8/2007 |
| DE | 60125369 | T2 | 10/2007 |
| DE | 102006021623 | A1 | 11/2007 |
| DE | 102006056051 | A1 | 5/2008 |
| DE | 102007018877 | A1 | 10/2008 |
| DE | 102007037663 | A1 | 2/2009 |
| DE | 10 2008 018 881 | A1 | 9/2009 |
| DE | 102008053178 | A1 | 5/2010 |
| DE | 102009029946 | A1 | 12/2010 |
| DE | 102009038462 | A1 | 3/2011 |
| DE | 102010004496 | A1 | 7/2011 |
| DE | 102010019612 | A1 | 11/2011 |
| DE | 102012006371 | A1 | 7/2012 |
| DE | 102012005087 | A1 | 10/2012 |
| DE | 102012005650 | A1 | 9/2013 |
| DE | 102012212469 | A | 1/2014 |
| DE | 102012109123 | A1 | 3/2014 |
| DE | 202013101134 | U1 | 6/2014 |
| DE | 102013002412 | A1 | 8/2014 |
| DE | 102013011107 | A1 | 8/2014 |
| DE | 102013205171 | A1 | 9/2014 |
| DE | 102014006991 | A1 | 12/2014 |
| DE | 102014007523 | A1 | 11/2015 |
| DE | 102014008183 | A1 | 12/2015 |
| DE | 102014012705 | A1 | 3/2016 |
| DE | 102014013158 | A1 | 3/2016 |
| EP | 0138322 | A1 | 4/1985 |
| EP | 0297309 | A2 | 1/1989 |
| EP | 0665106 | A2 | 8/1995 |
| EP | 1120258 | A2 | 8/2001 |
| EP | 1764226 | A1 | 3/2007 |
| EP | 1852733 | A1 | 11/2007 |
| EP | 1884365 | A1 | 2/2008 |
| EP | 1946846 | A2 | 7/2008 |
| EP | 2002898 | A1 | 12/2008 |
| EP | 2133154 | A2 | 12/2009 |
| EP | 2151282 | A1 | 2/2010 |
| EP | 2196267 | A2 | 6/2010 |
| EP | 2380744 | A2 | 10/2011 |
| EP | 2433716 | A1 | 3/2012 |
| EP | 2468512 | A1 | 6/2012 |
| EP | 2641661 | A1 | 9/2013 |
| EP | 2644392 | A2 | 10/2013 |
| EP | 2777938 | A1 | 9/2014 |
| EP | 2799150 | A1 | 11/2014 |
| EP | 2842753 | A1 | 3/2015 |
| EP | 3002128 | A2 | 4/2016 |
| EP | 3156138 | A1 | 4/2017 |
| EP | 3213823 | A1 | 9/2017 |
| EP | 3257590 | A1 | 12/2017 |
| EP | 3272669 | A1 | 1/2018 |
| EP | 3068626 | B1 | 10/2019 |
| FR | 3010918 | A1 | 3/2015 |
| GB | 2200433 | A | 8/1988 |
| GB | 2367771 | A | 4/2002 |
| GB | 2507069 | A | 4/2014 |
| JP | S5722070 | A | 2/1982 |
| JP | S62116442 | A | 5/1987 |
| JP | H04-106669 | U | 9/1992 |
| JP | H0798171 | B2 | 10/1995 |
| JP | H09192583 | A | 7/1997 |
| JP | 2000158670 | A | 6/2000 |
| JP | 2000317354 | A | 11/2000 |
| JP | 2001129456 | A | 5/2001 |
| JP | 2001157863 | A | 6/2001 |
| JP | 2001239652 | A | 9/2001 |

(56) References Cited

FOREIGN PATENT DOCUMENTS

| | | | |
|---|---|---|---|
| JP | 2001300404 | A | 10/2001 |
| JP | 2005501745 | A | 1/2002 |
| JP | 2002361863 | A | 12/2002 |
| JP | 2003506210 | A | 2/2003 |
| JP | 2003136030 | A | 5/2003 |
| JP | 2003164780 | A | 6/2003 |
| JP | 2004142382 | A | 5/2004 |
| JP | 2005526234 | A | 9/2005 |
| JP | 2007021760 | A | 2/2007 |
| JP | 2007152666 | A | 6/2007 |
| JP | 2007520340 | A | 7/2007 |
| JP | 2007245633 | A | 9/2007 |
| JP | 2007289848 | A | 11/2007 |
| JP | 2008110332 | A | 5/2008 |
| JP | 2009006324 | A | 1/2009 |
| JP | 2010528852 | A | 8/2010 |
| JP | 2010531213 | A | 9/2010 |
| JP | 2010531729 | A | 9/2010 |
| JP | 2010241003 | A | 10/2010 |
| JP | 2011206958 | A | 10/2011 |
| JP | 2012011310 | A | 1/2012 |
| JP | 2012506305 | A | 3/2012 |
| JP | 2012135925 | A | 7/2012 |
| JP | 2012206116 | A | 10/2012 |
| JP | 2012228643 | A | 11/2012 |
| JP | 2012228660 | | 11/2012 |
| JP | 2013067179 | A | 4/2013 |
| JP | 2013530816 | A | 8/2013 |
| JP | 2013530816 | B2 | 8/2013 |
| JP | 2013188706 | A | 9/2013 |
| JP | 2014019140 | A | 2/2014 |
| JP | 2014050832 | A | 3/2014 |
| JP | 2014111307 | A | 6/2014 |
| JP | 2015-009222 | A | 1/2015 |
| JP | 2015096322 | A | 5/2015 |
| JP | 2015520011 | A | 7/2015 |
| JP | 2015193129 | A | 11/2015 |
| JP | 2016507372 | A | 3/2016 |
| JP | 2016526910 | A | 9/2016 |
| JP | 2016175077 | A | 10/2016 |
| JP | 2016175662 | A | 10/2016 |
| JP | 2018012065 | A | 1/2018 |
| JP | 2020513311 | A | 5/2020 |
| JP | 2020513314 | A | 5/2020 |
| WO | 8601775 | A1 | 3/1986 |
| WO | 9856585 | A1 | 12/1998 |
| WO | 02098576 | A1 | 12/2002 |
| WO | 03021519 | A1 | 3/2003 |
| WO | 2003062129 | A2 | 7/2003 |
| WO | 2004048112 | A1 | 6/2004 |
| WO | 2004085738 | A2 | 10/2004 |
| WO | 2005016556 | A1 | 2/2005 |
| WO | 2005075170 | A1 | 8/2005 |
| WO | 2006022217 | A1 | 3/2006 |
| WO | 2007121905 | A1 | 11/2007 |
| WO | 2009019036 | A1 | 2/2009 |
| WO | 2010046064 | A1 | 4/2010 |
| WO | 2010146473 | A1 | 12/2010 |
| WO | 2011044491 | A1 | 4/2011 |
| WO | 2011128439 | A1 | 10/2011 |
| WO | 2011138048 | A1 | 11/2011 |
| WO | 2013121565 | A1 | 8/2013 |
| WO | 2015071270 | A1 | 5/2015 |
| WO | 2015096322 | A1 | 7/2015 |
| WO | 2015186014 | A1 | 12/2015 |
| WO | 2016-087016 | A1 | 6/2016 |
| WO | 2016142510 | A1 | 9/2016 |
| WO | 2016145000 | A1 | 9/2016 |
| WO | 2017006245 | A1 | 1/2017 |
| WO | 2017006246 | A1 | 1/2017 |
| WO | 2018102846 | A1 | 6/2018 |

OTHER PUBLICATIONS

Chinese Office Action dated Jun. 2, 2021 for Application No. CN201780077017.9 (17 pages; with English machine translation).

Japanese Notification of Reasons for Rejection dated Jun. 1, 2021 for Application No. JP2019-531944 (14 pages; with English machine translation).

Japanese Notification of Reasons for Rejection dated Jun. 8, 2021 for Application No. JP2019-531957 (13 pages; with English machine translation).

Supplemental Notice of Allowability dated Jul. 8, 2021 for U.S. Appl. No. 16/468,696 (11 pages).

Liptak, Bela. (2006). Instrument Engineers' Handbook (4th Edition)—Process Control and Optimization, vol. 2—2.1.3.5 Process Time Constant, (pp. 99-102). Taylor & Francis. Retrieved from https://app.knovel.eom/hotlink/pdf/id:kt00CC7HL1/instrument-engineers/process-time-constant (Year: 2006).

Final Office Action dated Jun. 11, 2021 for U.S. Appl. No. 16/468,701 (53 pages).

Non-Final Office Action dated Apr. 28, 2021 for U.S. Appl. No. 16/468,693 (109 pages).

Final Office Action dated Apr. 19, 2021 for U.S. Appl. No. 16/468,700 (62 pages).

Ghasem, G. et al; "Chapter 2 Background on Sprays and Their Production", Industrial Sprays and Atomization: Design, Analysis and Applications, Jan. 1, 2002, Springer, London, pp. 7-33, XP009195118, ISBN: 978-1-4471-3816-7.

International Search Report and Written Opinion for PCT/EP2017/081141 dated Feb. 26, 2018 (17 pages; with English translation).

International Search Report and Written Opinion for PCT/EP2017/081114 dated May 15, 2018 (33 pages; with English translation).

Anonymous: "Roboterkalibrierung—Wikipedia", Nov. 7, 2016, XP055471615, Gefunden im Internet: URL: https://de.wikipedia.org/w/index.php?title=Roboterkalibrierung&oldid=159460756 [gefunden am Apr. 30, 2018] das ganze dockument (8 pages; with English translation).

Beyer, Lukas: "Genauigkeitssteigerung von Industrierobotern", Forschungsberichte Aus Dem Laboratorium Fertigungstechnik/Helmut-Schmidt-Universitat, Universitat Der Bundeswehr Hamburg, Dec. 31, 2005, Seiten 1-4, XP009505118; ISSN: 1860-2886; ISBN: 978-3-8322-3681-6 (13 pages; with English machine translation).

International Search Report and Written Opinion for PCT/EP2017/081108 dated Feb. 28, 2018 (with English translation; 18 pages).

International Search Report and Written Opinion for PCT/EP2017/081099 dated Feb. 26, 2018 (21 pages; with English translation).

International Search Report and Written Opinion for PCT/EP2017/081102 dated Mar. 14, 2018 (16 pages; with English translation).

International Search Report and Written Opinion for PCT/EP2017/081105 dated Feb. 26, 2018 (19 pages; with English translation).

International Search Report and Written Opinion for PCT/EP2017/081152 dated May 15, 2018 (25 pages; with English translation).

International Search Report and Written Opinion for PCT/EP2017/081098 dated May 14, 2018 (26 pages; with English translation).

International Search Report and Written Opinion for PCT/EP2017/081101 dated Feb. 28, 2018 (14 pages; with English translation).

International Search Report and Written Opinion for PCT/EP2017/081121 dated Feb. 26, 2018 (20 pages; with English translation).

International Search Report and Written Opinion for PCT/EP2017/081117 dated Mar. 12, 2018 (27 pages; with English translation).

International Search Report and Written Opinion for PCT/EP2017/081123 dated Feb. 26, 2018 (20 pages; with English translation).

JPO Notification of Reasons for Rejection for Application No. JP2019-532030 dated May 18, 2021 (6 pages; with English translation).

CIPO Office Action for Application No. CN201780077474.8 dated Apr. 26, 2021 (17 pages; with English translation).

JPO Office Action for Application No. JP2019-531097 dated Jun. 29, 2021 (10 pages; with English machine translation).

JPO Office Action for Application No. 2019-531096 dated Jul. 6, 2021 (9 pages; with English machine translation).

JPO Office Action for Application No. 2019-531098 dated Jul. 6, 2021 (5 pages; English translation only).

(56) References Cited

OTHER PUBLICATIONS

JPO Office Action for Application No. 2019-531459 dated Jul. 6, 2021 (8 pages; with English machine translation).
Notification of Reasons for Refusal for Application No. JP2019-532012 dated Jun. 22, 2021 (6 pages; with English machine translation).
Notification of Reasons for Refusal for Application No. JP2019-527330 dated Jun. 22, 2021 (10 pages; with English machine translation).
Non-Final Office Action dated Feb. 5, 2021 for U.S. Appl. No. 16/468,701 (80 pages).
Non-Final Office Action dated Feb. 18, 2021 for U.S. Appl. No. 16/468,692 (97 pages).
Chinese Office Action for Application No. CN20178007017.9 dated Aug. 31, 2020 (8 pages; with English translation).
Non Final Office Action for U.S. Appl. No. 16/468,697 dated Oct. 22, 2020 (78 pages).
Non Final Office Action for U.S. Appl. No. 16/468,696 dated Nov. 2, 2020 (58 pages).
Non Final Office Action for U.S. Appl. No. 16/468,689 dated Oct. 15, 2020 (77 pages).
Chinese Office Action for CN201780077476.7 dated Sep. 23, 2020 (12 pages; English translation not available).
Non Final Office Action for U.S. Appl. No. 16/468,700 dated Dec. 1, 2020 (73 pages).
EPO Examination Report for Application No. 201702818.1 dated Dec. 18, 2020 (with English machine translation; 6 pages).
JPO Submission for JP2019-531096; dated Dec. 21, 2020 (32 pages; with English translation).
JPO Submission for JP2019-531957; dated Dec. 21, 2020 (21 pages; with English translation).
Fianl Office Action dated May 13, 2021 for U.S. Appl. No. 16/468,691 (70 pages).
Non-Final Office Action for U.S. Appl. No. 16/468,691 dated Jan. 7, 2021 (79 pages).
Notice of Allowance mailed in U.S. Appl. No. 16/468,689 dated Jun. 2, 2021 (38 pages).
China National Intellectual Property Administration Office Action and Search Report for CN Application No. 201780077018.3 dated Aug. 27, 2020 (11 pages; Search Report in English).
Final Office Action dated Mar. 19, 2021 for U.S. Appl. No. 16/468,696 (45 pages).
Chinese Office Action and Search Report for CN201780077603.3 dated Oct. 12, 2020 (15 pages; English translation not available).
European Search Report for EP20170638.9 dated Sep. 14, 2020 (4 pages—English translation not available).
European Search Report for EP20170021.8 dated Sep. 8, 2020 (11 pages—English translation not available).
European Search Report for EP20170025.9 dated Sep. 9, 2020 (4 pages—English translation not available).
European Search Report for EP20170016.8 dated Sep. 7, 2020 (4 pages—English translation not available).
Japenese Patent Office Notice of Reasons of Refusal for Application No. JP 2019-531967 dated Jun. 8, 2021 (8 pages; with English machine translation).
JPO Office Action dated Jul. 3, 2021 for Application No. JP2019-532024 (12 pages; with English machine translation).
Non-Final Office Action dated Dec. 24, 2021 for related U.S. Appl. No. 16/468,693 (19 pages).
Non-Final Office Action dated Jan. 6, 2022 for related U.S. Appl. No. 16/468,701 (36 pages).
JPO Decision to Grant dated Oct. 3, 2021 for Application No. JP2019-532113 (7 pages; with English machine translation).
Final Office Action dated Oct. 7, 2021 for U.S. Appl. No. 16/468,693 (58 pages).
Non Final Office Action dated Nov. 23, 2021 for U.S. Appl. No. 16/468,694 (163 pages).
JPO Decision to Grant in related application JP2019-532012 dated Jan. 25, 2022 (6 pages; with English machine translation).
JPO Decision to Grant in related application No. JP2019-532030 dated Dec. 1, 2022 (6 pages; English machine translation provided).
Chinese Office Action in related application No. CN201780077045.0 dated Jan. 29, 2022 (17 pages; English machine translation provided).
Non-Final Office Action for related U.S. Appl. No. 16/468,699 dated Mar. 9, 2022 (180 pages).

* cited by examiner

PRINT HEAD AND ASSOCIATED OPERATING METHOD

CROSS-REFERENCE TO RELATED APPLICATIONS

This application is a national stage of, and claims priority to, Patent Cooperation Treaty Application No. PCT/EP2017/081152, filed on Dec. 1, 2017, which application claims priority to German Application No. DE 10 2016 014 9483.5, filed on Dec. 14, 2016, which applications are hereby incorporated herein by reference in their entireties.

BACKGROUND

The disclosure concerns a printhead for the application of a coating agent to a component, in particular for painting a vehicle body component with a paint. The disclosure also includes an operating method for such a printhead.

For the serial coating of vehicle body components, rotary atomizers are usually used as application devices, but these have the disadvantage of limited application efficiency, i.e. only part of the applied paint deposits on the components to be coated, while the rest of the applied paint has to be disposed of as so-called overspray.

A newer development line, on the other hand, provides for so-called printheads as application devices, as known for example from DE 10 2013 002 412 A1, U.S. Pat. No. 9,108,424 B2 and DE 10 2010 019 612 A1. In contrast to the known rotary atomizers, such printheads do not emit a spray of the paint to be applied, but a narrowly confined paint jet, which is almost completely deposited on the component to be painted, so that almost no overspray occurs.

Such printheads have control valves for controlling the release of the coating agent. FIG. 1 shows a schematic representation of such a control valve arranged in a printhead.

Here there is a nozzle opening 2 in a nozzle plate 1, which is either released or blocked by the control valve. In the nozzle plate 1 there are further nozzle openings beside the nozzle opening 2, which are each controlled by a separate control valve, whereby these further nozzle openings are not shown for simplification.

Furthermore, the printhead contains a base plate 3, which confines a coating agent supply 4, i.e. the coating to be coated is supplied via the coating agent supply 4 and can then exit through the nozzle opening 2 when the control valve is open.

A coil tube 5 is arranged on the upper side of the base plate 3 and is wound with a coil 6 on the outside.

In the coil tube 5 there is a magnetic coil core 7, which is fixed and sealed against the coil tube 5 by a seal 8.

In addition, there is a magnetic armature 9 in the coil tube 5, which can also be called a valve needle and can be moved in the direction of the double arrow depending on the current supplied to the coil 6 in order to either release or close the nozzle opening 2.

The armature 9 carries a seal 10 at its lower end to seal the nozzle opening 2 in the shown closed position so that no paint can escape from the nozzle opening 2.

In addition, the control valve has a return spring 11, which pushes the armature 9 and thus also the seal 10 in the drawing downwards into the shown closing position.

To open the control valve, the coil 6 is energised in such a way that the armature 9 with the seal 10 is actively pulled upwards in the drawing against the force of the return spring 11.

To close the control valve, on the other hand, the coil 6 is de-energised so that the return spring 11 can push the armature 9 and thus also the seal 10 in the drawing downwards into the closed position shown.

A disadvantage of this well-known control valve is the fact that the interior of the control valve and especially an interior 12 of the coil tube 5 is exposed to the paint.

On the one hand, paint residues in the interior 12 of the coil tube 5 can therefore impair the functionality of the control valve. For example, paint deposits in the control valve can impair the freedom of movement of the armature 9.

On the other hand, the paint residues in the interior 12 of the coil tube 5 also prevent a colour change, since the control valve cannot be rinsed during operation. The well-known printheads with control valves of this type also offer the possibility of applying a different colour paint.

One possibility is to remove, disassemble, clean and reassemble the control valve, which, however, takes 1-2 hours and therefore prevents a colour change during operation.

Another possibility for a colour change is to rinse the printhead with an extremely high amount of rinsing agent of several litres and over a longer period of several minutes, which also prevents a colour change during operation due to the required amount of rinsing agent and the required rinsing time.

Finally, it is possible to replace the control valve or the complete printhead, but this is also not possible during operation and therefore prevents a colour change.

The known printheads described above therefore do not allow a practical color change during operation.

The technical background of the disclosure can also be found in DE 696 22 407 T2 and DE 36 34 747 A1.

DETAILED DESCRIPTION

Figure 1:
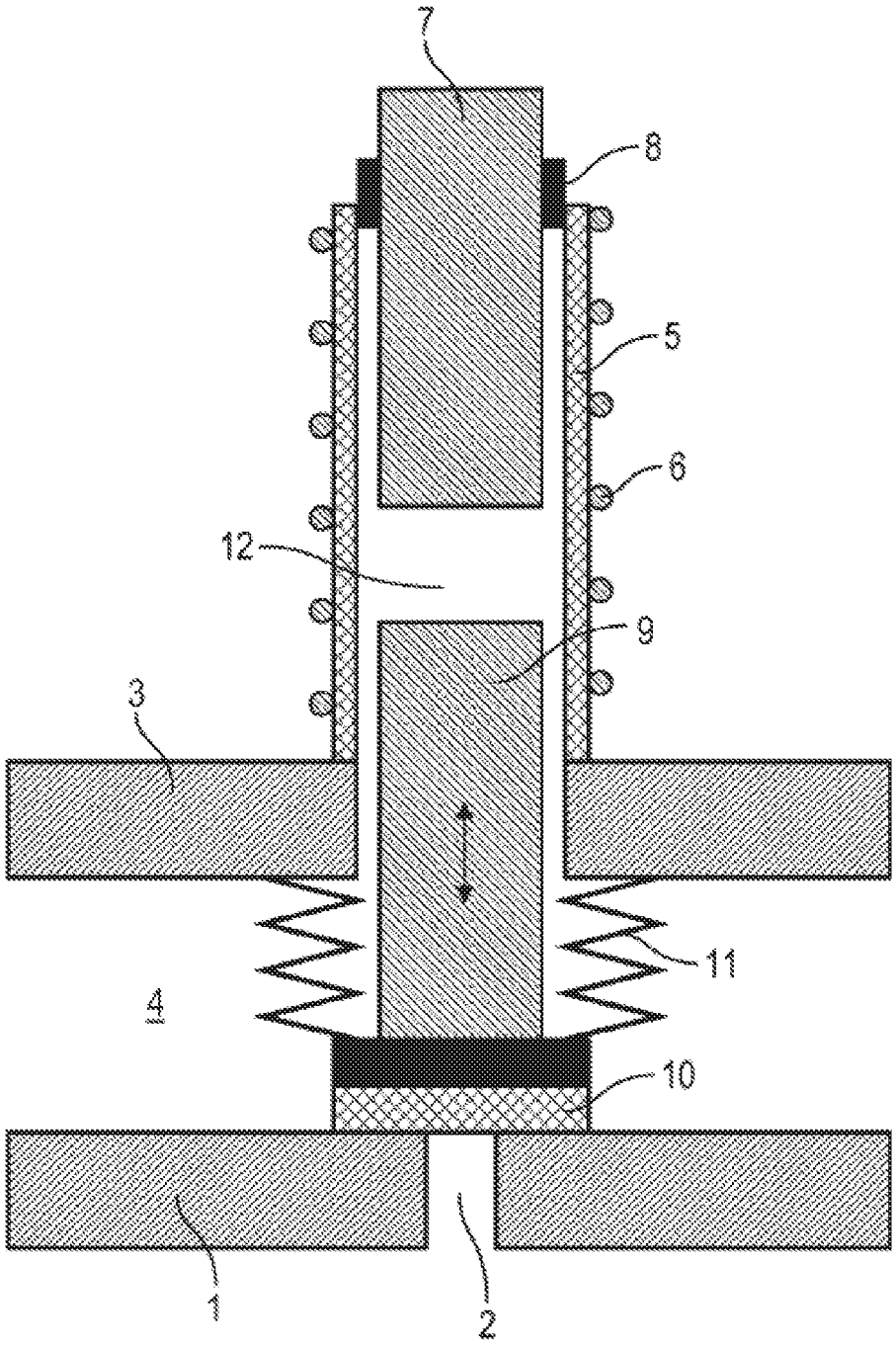
Fig. 1 Prior art
FIG. 1 shows a schematic representation of a conventional control valve in a printhead for paint application.

The disclosure is therefore based on the task of creating a correspondingly improved printhead and specifying a corresponding operating method.

The disclosure comprises the general technical teaching to design the printhead technically in such a way that a colour change is possible during the coating process. This is achieved by the fact that the printhead can be rinsed with a rinsing agent during a colour change in order to rinse out coating agent residues from the printhead.

In accordance with the state of the art, the printhead according to the disclosure has a coating supply in order to feed the coating to be applied to the printhead. In addition, printhead according to the disclosure preferably also has a separate rinsing agent supply to supply a rinsing agent. It should be mentioned here that the coating agent supply is preferably separated from the rinsing agent supply, so that the printhead preferably has separate inlets for the supply of the coating agent on the one hand and for the supply of the rinsing agent on the other hand.

For a few colors, one color hose (coating agent supply) per color could be connected to the applicator (printhead). Then there is a rinsing agent connection and a pulse air connection in or on the applicator. These are then used for rinsing.

In addition, the printhead according to the disclosure also may have a return system in order to return coating agents and/or rinsing agents, either to a ring line or to disposal. In addition to the separate connections for the supply of the coating agent and the rinsing agent, the printhead in accordance with the disclosure therefore also preferably has a further separate connection in order to return coating agent or rinsing agent.

The return flow to the return system, in one example is controlled by a controllable return valve, which can be designed as a self-actuated return valve or as a proportional valve. Such valve types are known from the state of the art and therefore do not need to be described in detail.

In one example, the printhead has several nozzles to dispense the coating agent. The individual nozzles are preferably each assigned a control valve in order to control the release of coating agent through the respective nozzle. The above mentioned rinsing agent supply then has branch lines leading to the individual control valves so that all control valves of the printhead can be rinsed simultaneously with the rinsing agent.

In one example, the individual branch lines of the rinsing agent supply are y designed in such a way that the rinsing agent supplied is evenly distributed to the branch lines to the control valves, so that the individual control valves are essentially rinsed with the same amount of rinsing agent.

In one example the printhead has at least one nozzle for dispensing the coating agent and an associated control valve for controlling the dispensing of the coating agent through the nozzle, as explained briefly above. The control valve may have an electrical coil, as in the known design described above, which may be wound onto a coil tube. It was already explained at the beginning about the state of the art that coating residues can be deposited in this coil tube, which on the one hand can impair the functionality of the control valve and on the other hand can prevent the colour change capability. Therefore, the rinsing agent supply line of the printhead according to the disclosure preferably flows into the coil tube in order to rinse the inside of the coil tube.

It should be mentioned here that the coil tube—as with the conventional control valve described at the beginning—preferably has a circular internal cross-section and contains a coil core. Here it can be advantageous if the coil core has a profile cross section that does not completely fill the inner cross section of the coil tube in order to leave space for the rinsing agent between the coil tube and the coil core so that the rinsing agent can flow through in the axial direction. For example, the coil core may have a star-shaped profile cross-section with radially projecting ribs running in the axial direction, so that the rinsing agent can flow between the ribs of the coil core in the axial direction.

Alternatively, it is possible for the coil core to have a rinsing groove in its circumferential surface that can run axially, in the circumferential direction or spirally, for example.

In addition, axial rinsing channels can also be arranged in the coil core.

Another example provides that the profile cross-section of the coil core is grid-shaped and can be flowed through by the rinsing agent.

It should also be mentioned that the coil core is preferably sealed against the coil tube with a seal, in particular with a pressure resistance of more than 2 bar, 4 bar or 6 bar.

It has already been briefly mentioned above that the printhead may have several control valves, all of which can be rinsed. The individual control valves usually have one coil tube each, whereby the rinsing agent supply then opens into all coil tubes in order to rinse all coil tubes.

It should also be mentioned that the control valve usually has a movable armature, as in the known control valve described at the beginning, which is moved depending on the current supplied to the coil and closes or releases the nozzle depending on its position.

In one example, this armature runs coaxially on part of its length in the coil tube and preferably has an axially permeable profile cross-section so that rinsing agent can flow between the armature and the inner wall of the coil tube. For this purpose, the armature preferably has a non-circular profile cross-section which does not completely fill the circular internal cross-section of the coil tube and therefore permits axial flow of the rinsing agent. For example, the profile cross-section of the armature can be star-shaped or cross-shaped.

In a variant of the disclosure, the rinsing agent supply opens into the coil tube axially between the armature and the coil core.

In another variant of the disclosure, on the other hand, the rinsing agent supply opens into the coil tube in the axial direction in the area of the coil core, in particular at the end of the nozzle tube remote from the moving armature.

In another variant of the disclosure, the movable armature is arranged in a guide cage permeable to rinsing agent, in particular in a slotted cylinder. This offers the advantage that the movable anchor can be rinsed during a rinsing process, thus avoiding coating deposits on the anchor.

In another variant of the disclosure, the sliding anchor has a central guide hole with a guide pin projecting into the guide hole. This results in a linear guide, which can also be rinsed.

In another example of the disclosure, a flexible diaphragm is provided which separates the control valve from the coating agent supply so that the control valve is protected by the diaphragm against contact with a coating agent. This means that the control valve itself does not have to be rinsed at all, as the control valve itself does not come into contact with the respective coating agent at all. Rather, only the smooth surface of the membrane on the coating agent side should be rinsed, which is, however, very easy and efficient, since the smooth membrane surface hardly forms any starting points for paint deposits.

The printhead according to the disclosure preferably enables a fast color change within a color change time of less than 1 h, 20 min, 10 min, 30 s, 10 s or even less than 5 s.

The aim is to achieve the lowest possible paint change losses, which are preferably smaller than 51, 21, 200 ml, 20 ml, 10 ml, 5 ml or even smaller than 2 ml with the printhead according to the disclosure.

This also leads advantageously to a very low rinsing agent consumption during a colour change, whereby the rinsing agent consumption is preferably smaller than 101, 51, 21, 200 ml, 100 ml, 50 ml, 20 ml or even smaller than 10 ml.

Furthermore, the disclosure allows the printhead to have several separate rinsing agent supplies to supply different rinsing agents, which can be adapted to the respective coating agent, for example.

It should also be mentioned that the printhead with its media-carrying parts is preferably designed in such a way that the media-carrying parts are free of dead space and/or undercutting in order to improve the rinsing capability.

To improve rinsability, it is also possible for the printhead to have a cleaning-enhancing coating on its surfaces that come into contact with the coating agent, whereby such a coating is also known as an "easy-to-clean coating".

Furthermore, it should be noted that the disclosure does not only claim protection for the printhead according to the disclosure described above as a single component or as a replacement part. Rather, the disclosure also claims protection for a complete coating device with such a printhead.

In addition, the coating device according to the disclosure preferably also includes a color changer, such as a linear color changer, a rotary color changer, a color changer integrated in the printhead or an A/B color changer. These types of color changers are known from the state of the art and therefore do not need to be described further.

Finally, the disclosure also includes a corresponding operating method for such a printhead, whereby the individual process steps already result from the above description and therefore do not need to be described in more detail.

However, it should be mentioned that the rinsing agent can be a universal rinsing agent suitable for both water-based and solvent-based coatings. In addition, the rinsing agent can be a VOC-free (VOC: volatile organic compounds) rinsing agent.

During the rinse process, the printhead can also be rinsed together with the rinse agent or alternately with pulsed air.

It is also possible to supply the printhead with an aerosol for rinsing.

The disclosure also offers the possibility of supplying the printhead with different rinsing agents one after the other.

In a variant of the operating method a solvent-based paint is first supplied and applied. The printhead is then rinsed with a solvent-based rinsing agent to rinse out residues of the solvent-based paint. An optional release agent can then be added, such as alcohol. In the next step, a water-based paint is added and applied. Finally, the printhead is rinsed with a water-paint-based rinsing agent to rinse out residues of the water-based paint.

The above description explains a change from a solvent-based coating paint to a water-based paint. It is also possible to change from a water-based paint to a solvent-based paint, which requires a correspondingly changed sequence of the process steps described above.

After a colour change, the printhead is preferably prefilled with the new coating agent, i.e. filled. A defined amount of coating agent is preferably applied through the nozzle of the printhead.

When operating the printhead according to the disclosure, there is also the possibility that all fluids (coating agent and rinsing agent) released during a rinsing process can be collected for disposal.

It is also possible to rinse the outer surface of the nozzle head during the colour change in order to remove any residues of coating agent adhering to it.

It should also be mentioned that the rinsing agent can be discharged one after the other or alternately into the return system or through the nozzle. In addition, there is also the option of rinsing with a mixture of rinsing agent and pulsed air.

Figure 2:
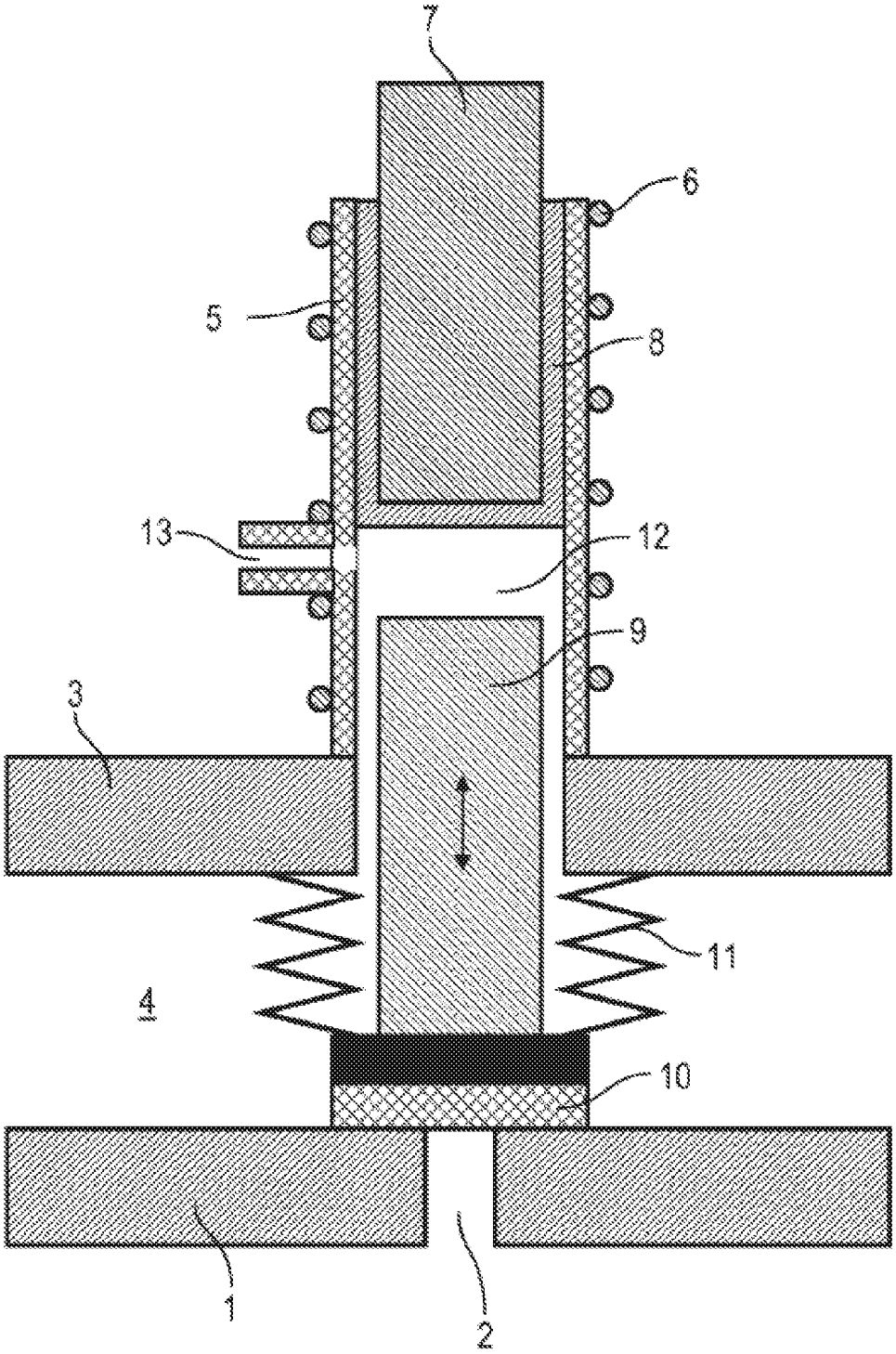
FIG. 2 shows a schematic diagram of the control valve with a rinsing agent supply.

In the following, the schematic representation of a control valve according to the disclosure in FIG. 2 is described, whereby the control valve is arranged in a printhead. This example of a control valve according to the disclosure partly corresponds to the conventional control valve described at the beginning and shown in FIG. 1, so that in order to avoid repetitions the above description is referred to, whereby the same reference signs are used for corresponding details.

A feature of this example is that the control valve has a rinsing agent supply 13 which opens into the interior 12 of the coil tube 5. This rinsing agent supply 13 can therefore be used to supply rinsing agent in order to rinse the control valve with a rinsing agent during a colour change. This makes it possible to change the colour during operation within a short period of time.

In addition, the control valve in this example has a design of the seal 8 between the coil core 7 and the coil tube 5, whereby the seal 8 enables a pressure resistance of more than 2 bar.

Figure 3:
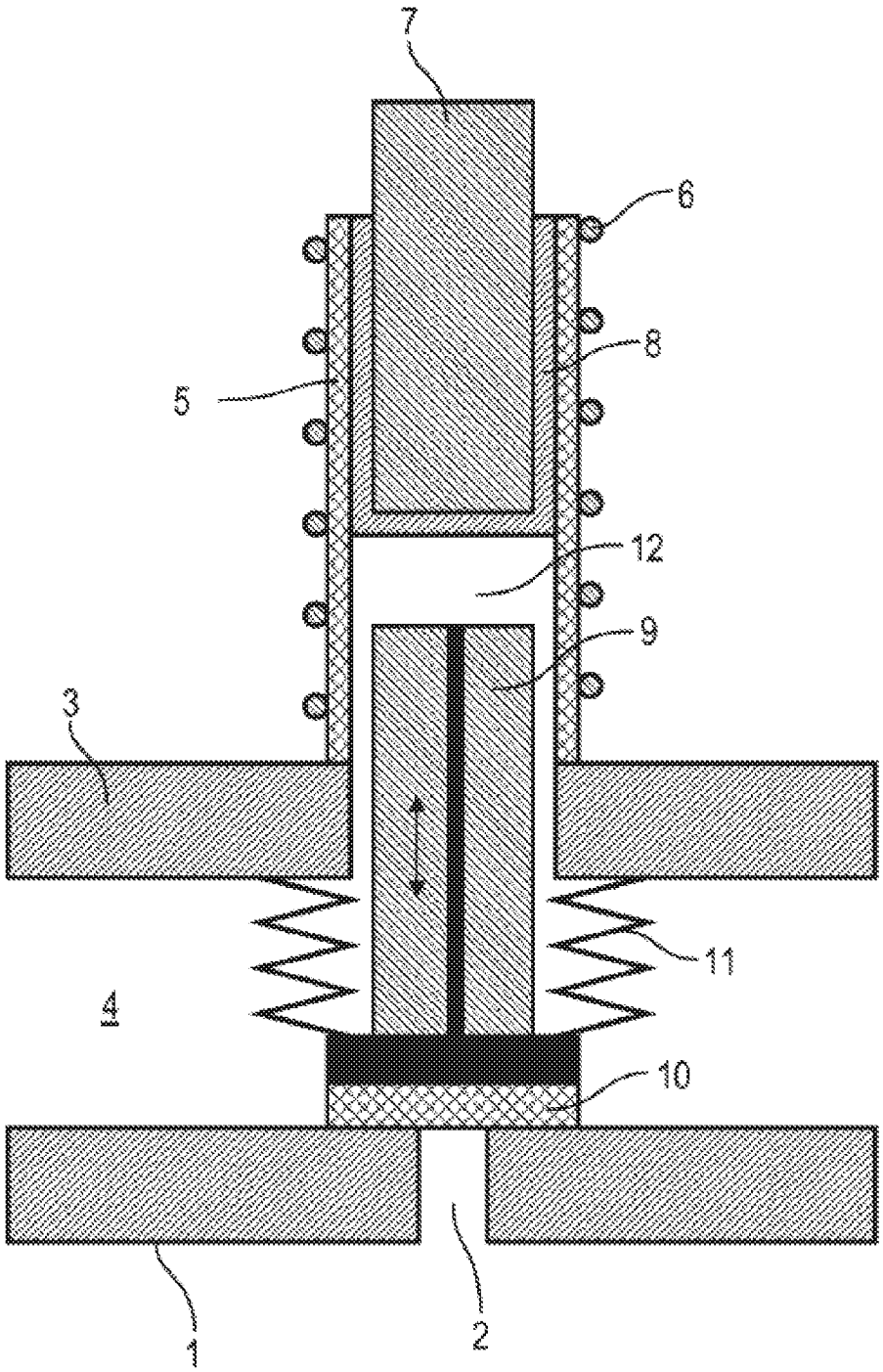
FIG. 3 is a modification of FIG. 2 in which the rinsing agent is supplied via the coating agent supply, FIG. 4 another modification with a rinsable guide cage for the anchor.

FIG. 3 shows a schematic representation of another design example of a control valve according to the disclosure in a printhead, wherein this example partially corresponds to the above example, so that reference is made to the above description to avoid repetition, using the same reference signs for corresponding details.

A feature of this example is that rinsing agent can flow around the sliding armature 9 freely so that the rinsing agent can also rinse the interior 12 of the coil tube 5. For this purpose, the armature 9 has a cross-shaped profile cross section with axially running ribs, so that the rinsing agent can flow between the ribs of the armature 9 in the axial direction into the interior 12 of the coil tube 5. The rinsing agent is therefore not supplied via the rinsing agent supply 13, as in FIG. 2, but via the coating agent supply 4, which serves alternately for the supply of coating agents and for the supply of rinsing agents. The coil core 7 is sealed against the interior 12 by the seal 8.

Figure 4:
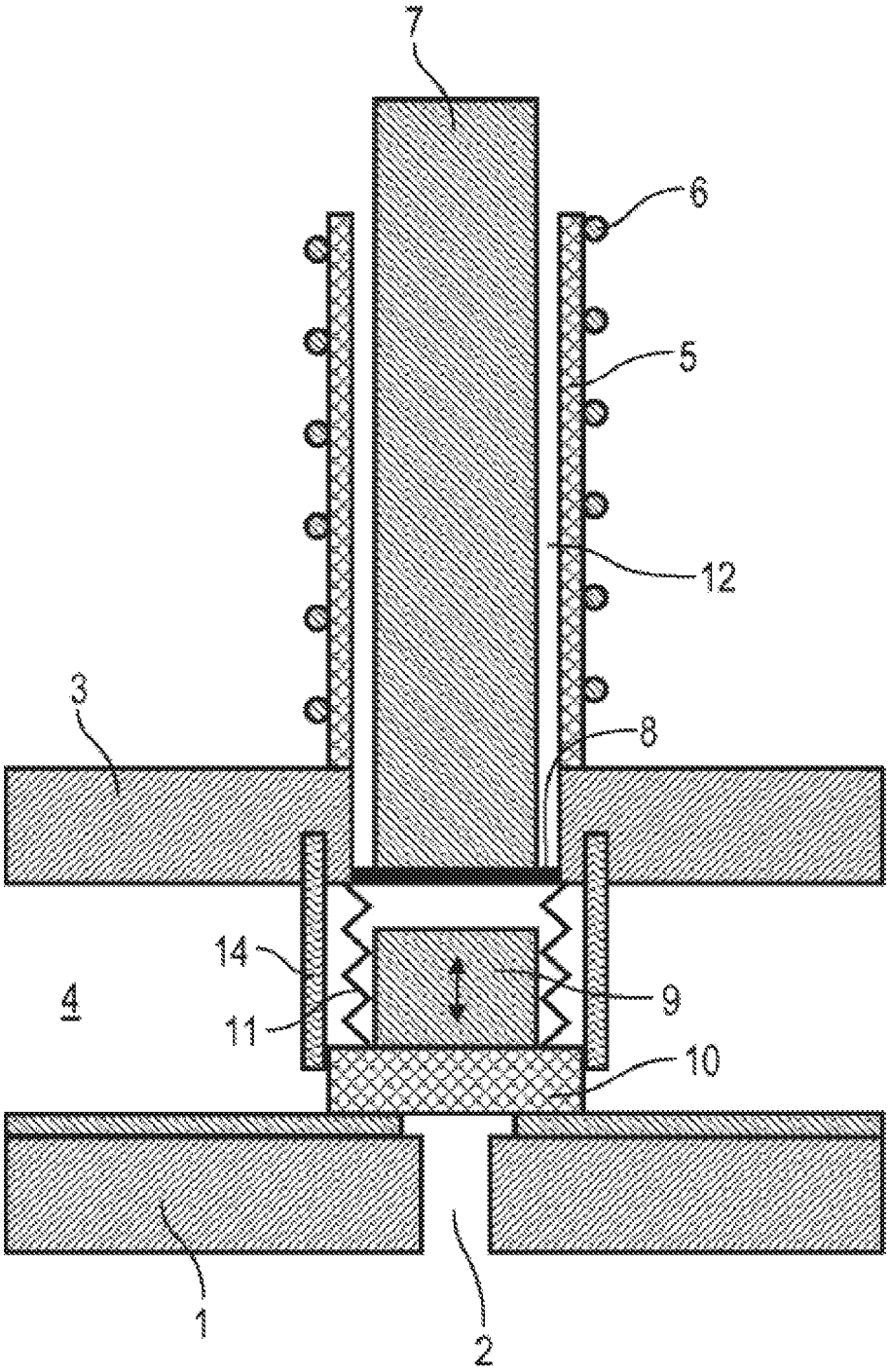

FIG. 4 shows another example, which also largely corresponds to the example described above, so that in order to avoid repetitions, reference is made to the above description, where the same reference signs are used for the corresponding details.

A feature of this example is that the sliding armature 9 is arranged in a rinsable guide cage 14 consisting of a slotted cylinder so that the inside of the guide cage 14 can be rinsed. The seal 8 seals the interior of the coil tube 5 against the media-carrying area.

Figure 5:
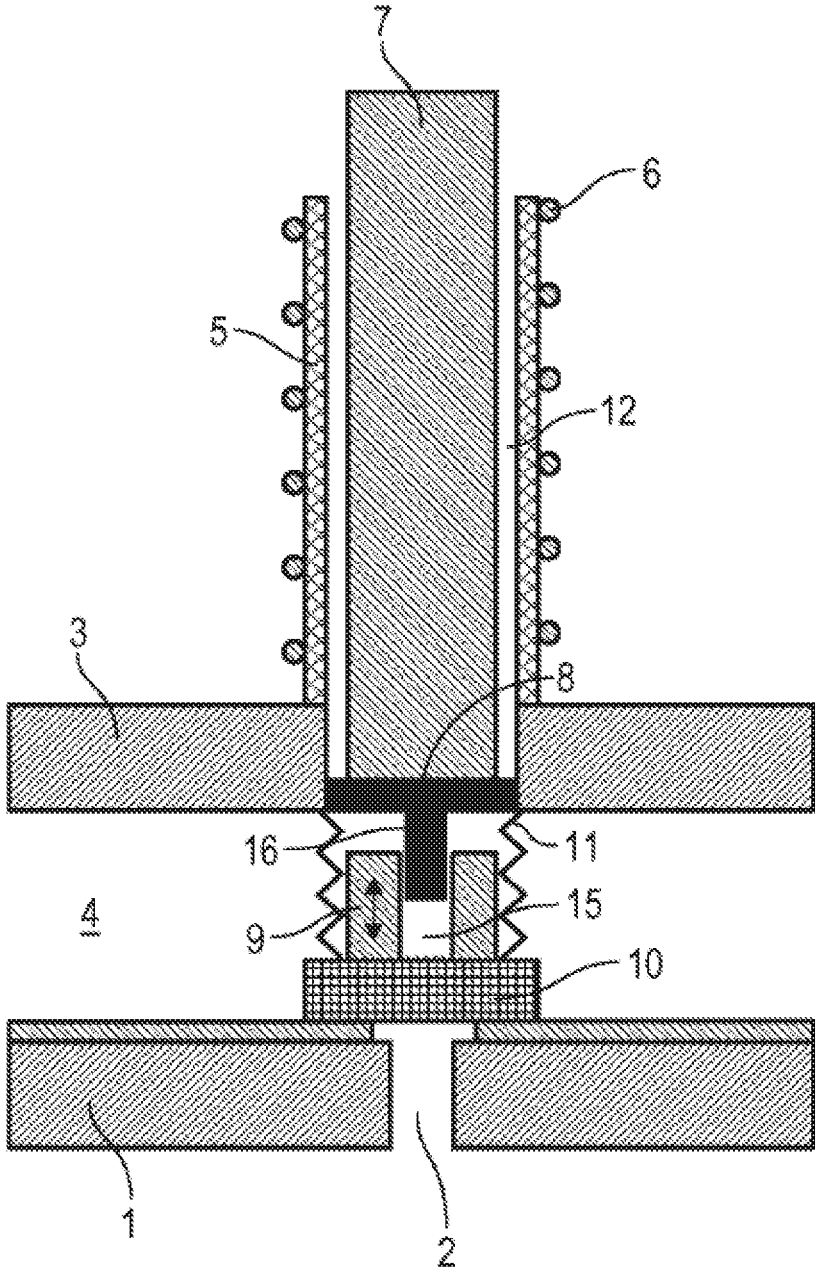
FIG. 5 shows another modification with a rinsable plunger.

FIG. 5 shows another example, so that the above description is referred to again to avoid repetitions, whereby the same reference signs are used for the corresponding details.

The armature 9 has a central guide hole 15 in which a guide pin 16 engages, whereby the fit of the guide hole 15 and the guide pin 16 is also accessible for rinsing agents.

In addition, the seal 8 seals the annular gap between the coil tube 5 and the coil core 7.

Figure 6:
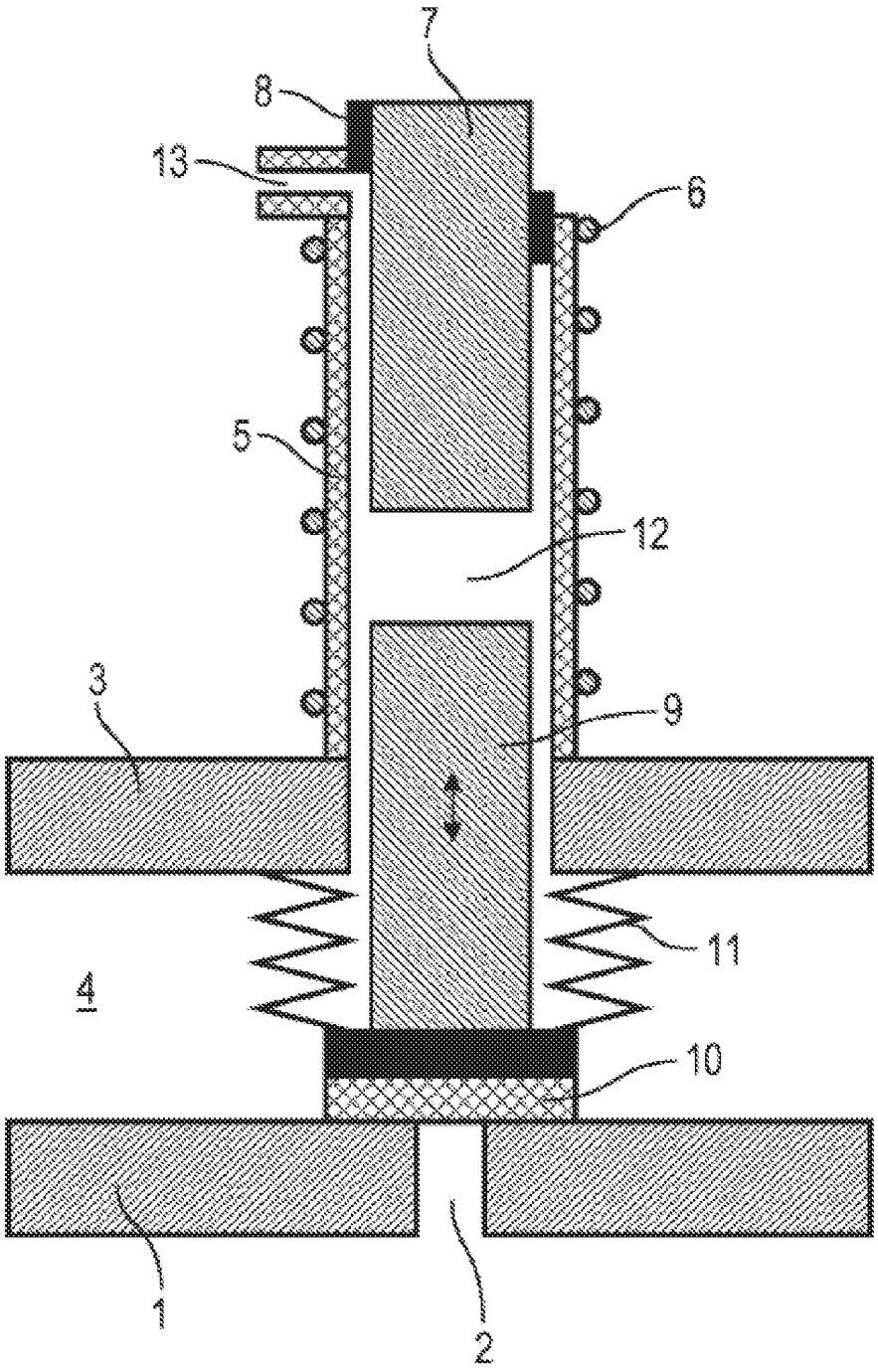
FIG. 6 shows a further modification with a rinsing agent supply at the upper end of the coil tube, FIG. 7 a modification with a flexible diaphragm to separate the control valve from the media carrying channels, FIG. 8 a schematic representation of an printhead according to the disclosure with an upstream color changer and a return, as well as FIG. 9 shows a schematic diagram of the supply of several control valves with rinsing agent and coating agent.

The example shown in FIG. 6 again partly corresponds to the example shown in FIG. 2, so that the above description is referred to avoid repetitions, whereby the same reference signs are used for corresponding details.

A feature of this example is that the rinsing agent supply 13 does not open between the coil core 7 and the armature 9 into the interior 12 of the coil tube. Rather, the rinsing agent supply 13 opens into the coil tube at the upper end of the coil tube 5.

It is noted here that the coil core 7 does not completely fill the free internal cross-section of the coil tube 5, as the rinsing agent can flow downwards from the rinsing agent supply 13 at the top into the interior 12.

Figure 7:
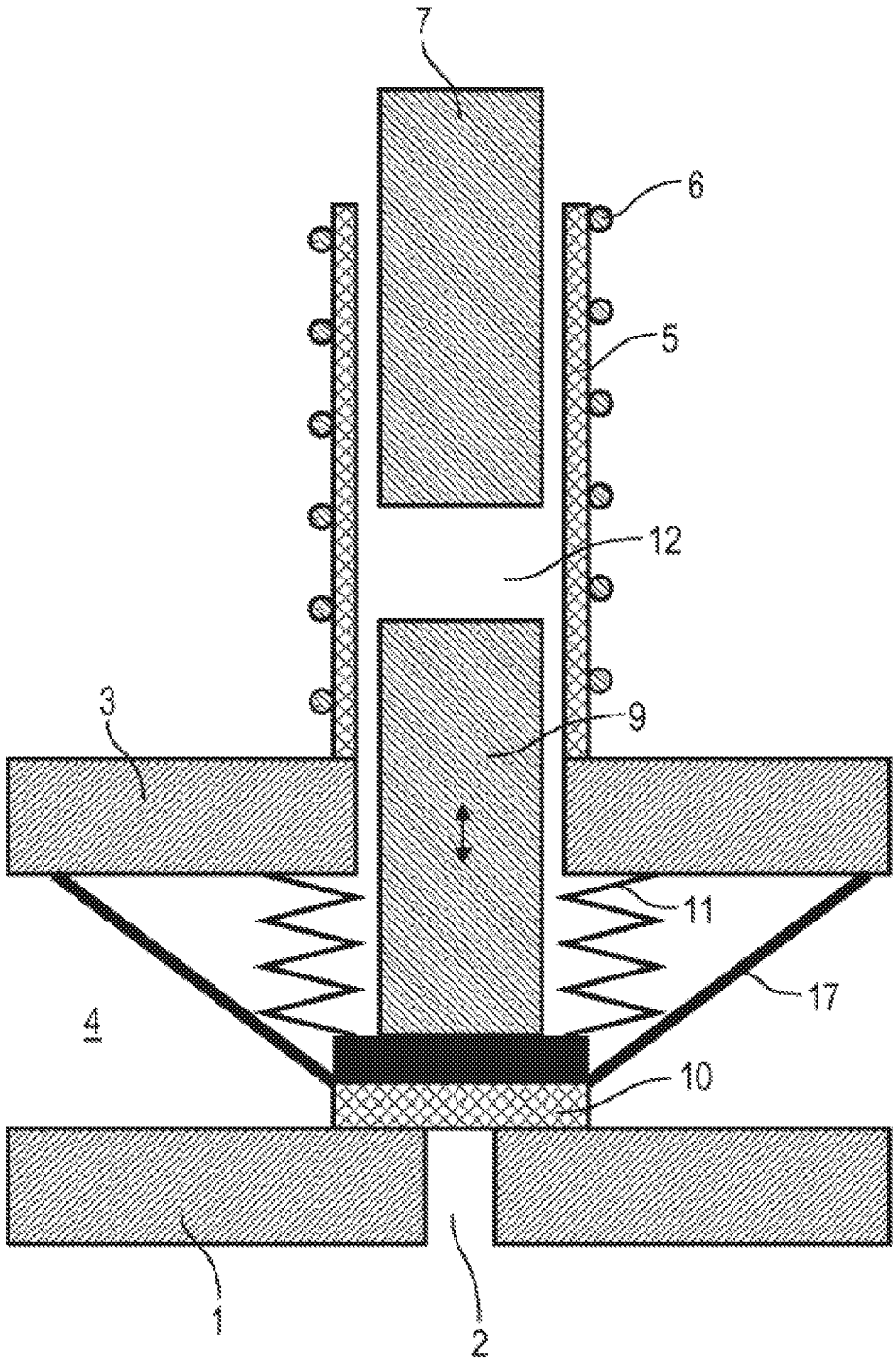

FIG. 7 shows a further modification of a rinsable control valve, which for this purpose provides a flexible diaphragm 17 which separates the control valve from the media-carrying parts in the coating agent supply 4. This means that the control valve itself does not have to be rinsed with rinsing agent, as the control valve itself does not come into contact with the paint at all. Rather, only the diaphragm 17 on its coating agent side is touched by the respective paint, so that only this side of the diaphragm 17 has to be rinsed, which is easily possible by supplying rinsing agent via the coating agent supply.

Figure 8:
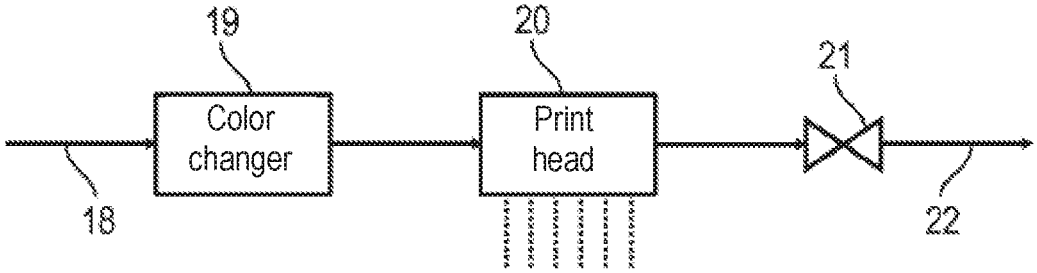

FIG. 8 shows a very simplified schematic representation of a coating device according to the disclosure with a coating agent supply 18, a colour changer 19, a printhead according to the disclosure 20, a return valve 21 and a return 22.

The colour changer 19 can supply the printhead 20 with different coloured coating agents, whereby the printhead 20 can optionally be rinsed with rinsing agent either via a rinsing agent supply (not shown) or via the coating agent supply 18.

Any residues of coating agent and rinsing agent arising during a rinsing process can then be discharged into the return 22.

Figure 9:
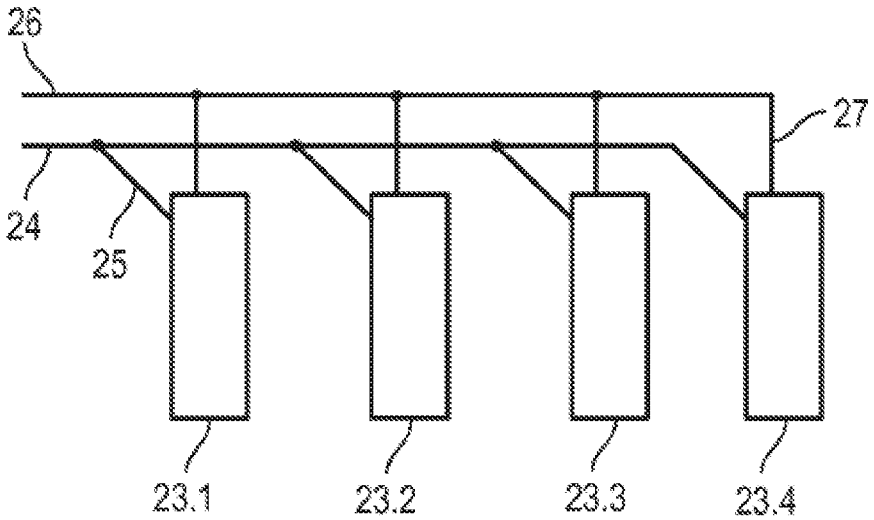

Finally, FIG. 9 shows a schematic representation of an printhead according to the disclosure with several control valves 23.1, 23.4, which are supplied with coating agent via a common coating agent supply 24 with several branch lines 25.

In addition, the coating device has a common rinsing agent supply 26 which is connected to the individual control valves 23.1-23.4 via one branch line 27 each, so that all control valves 23.1-23.4 of the printhead can be rinsed with rinsing agent.

The disclosure is not limited to the preferred examples described above. Rather, a large number of variants and modifications are possible which also make use of the disclosure idea and therefore fall within the scope of protection.

The invention claimed is:

1. An apparatus, comprising:

a printhead for applying a coating agent to a component, wherein the printhead enables a colour change during coating operation and can be rinsed with a rinsing agent during a colour change in order to rinse out coating agent residues from the printhead;

a coating agent supply for supplying at least one of the coating agent to be applied and the rinsing agent; and a separate rinsing agent supply for supplying the rinsing agent;

wherein:

a) the printhead has at least one nozzle for dispensing the coating agent, b) the printhead has at least one control valve for controlling the release of coating agent through the at least one nozzle, c) the control valve has an electric coil, d) the at least one control valve has a coil tube on which the coil is wound externally, e) the printhead has a rinsing agent supply for supplying the rinsing agent, and f) the rinsing agent supply opens into the coil tube and directs the rinsing agent into the interior of the coil tube.

2. The apparatus according to claim 1, characterized by a) a return system for recirculating at least one of the coating agent and rinsing agent; and b) a return valve for controlling the return flow into the return system.

3. The apparatus according to claim 2, wherein the return valve is a self-actuated return valve.

4. The apparatus according to claim 2, wherein the return valve is a proportional valve.

5. The apparatus according to claim 1, wherein a) the printhead comprises a plurality of nozzles for dispensing said coating agent, b) the printhead has a plurality of control valves associated with the individual nozzles and controlling the release of coating agent through the individual nozzles, c) the rinsing agent supply has branch lines to the individual control valves so that all the control valves are rinsed with the rinsing agent.

6. The apparatus according to claim 5, wherein the branch lines of the rinsing agent supply are designed such that the supplied rinsing agent is evenly distributed among the branch lines to the control valves so that the control valves are rinsed with substantially the same amount of rinsing agent.

7. The apparatus according to claim 1, wherein a) the coil tube has a circular internal cross-section, b) the coil tube contains a coil core in its interior.

8. The apparatus according to claim 7, wherein the coil core has a profile cross-section which does not completely fill the internal cross-section of the coil tube in order to leave space for the rinsing agent between the coil tube and the coil core.

9. The apparatus according to claim 7, wherein the profile cross-section of the coil core is star-shaped.

10. The apparatus according to claim 7, wherein the profile cross-section of the coil core has in its circumferential surface at least one rinsing groove.

11. The apparatus according to claim 10, wherein the rinsing groove runs axially.

12. The apparatus according to claim 10, wherein the rinsing groove runs in circumferential direction.

13. The apparatus according to claim 10, wherein the rinsing groove runs spirally.

14. The apparatus according to claim 7, wherein the profile cross-section of the coil core has an axially extending rinsing channel.

15. The apparatus according to claim 7, wherein the profile cross-section of the coil core is grid-shaped.

16. The apparatus according to claim 7, wherein the coil core is sealed with respect to the coil tube by means of a seal.

17. The apparatus according to claim 7, wherein a) the printhead comprises a plurality of coil tubes, and b) branch lines branch off from the rinsing agent supply into the coil tubes.

18. The apparatus according to claim 1, wherein the at least one control valve has a displaceable armature which is displaced as a function of the current supplied to the coil and closes or releases the nozzle as a function of its position.

19. The apparatus according to claim 18, wherein a) the armature extends coaxially in the coil tube over part of its length, b) the armature has an axially permeable profile cross-section in order to be able to pass rinsing agent through between the armature and the inner wall of the coil tube, c) the anchor has a non-circular profile cross-section in order to leave space for the coating agent.

20. The apparatus according to claim 18, wherein the rinsing agent supply opens into the coil tube in an axial direction between the armature and the coil core in order to supply the rinsing agent.

21. The apparatus according to claim 18, wherein the rinsing agent supply opens into the coil tube in an axial direction in the region of the coil core.

22. The apparatus according to claim 18, wherein a) the control valve has a displaceable armature which is displaced as a function of the current applied to the coil and closes or releases the nozzle as a function of its position, and b) the armature is arranged in a guide cage which is permeable to rinsing agent.

23. The apparatus in accordance with claim 18, wherein a) the displaceable armature has a central guide hole, and b) a stationary guide pin projects into the guide hole of the movable armature, and c) the guide hole can be rinsed in the displaceable anchor core.

24. The apparatus according to claim 1, further comprising a flexible diaphragm separating the control valve from the coating agent supply so that the control valve is protected by the membrane from contact with the coating agent.

25. The apparatus according to claim 1, wherein a) the printhead allows colour change within a colour change time of less than 30 s, b) the colour change does not take longer than the infeed or outfeed of the coating object from the painting zone, and c) the colour change takes place in the time gap given by the distance between two coating objects; and d) the printhead has small colour change losses during a colour change which are smaller than 51, and e) the printhead has a low rinsing agent consumption during a colour change which is smaller than 101, and f) the printhead has a plurality of separate rinsing agent supplies for supplying different rinsing agents.

26. The apparatus according to claim 1, further comprising a colour changer which is arranged upstream of the printhead and is connected on the output side to the printhead in order to feed the printhead selectively with coating agents of different colours.

* * * * *